United States Patent [19]

Jonasson et al.

[11] Patent Number: 5,044,446

[45] Date of Patent: Sep. 3, 1991

[54] CONSTANT PRESSURE REGULATION OF GRADER BLADES

[75] Inventors: Karl-Jonas Jonasson; Bo Tibäck, both of Borlänge; Lars-Ake Hedberg, Falun; Alf Wallin, Borlänge, all of Sweden

[73] Assignee: Maskin AB Tube, Huddinge, Sweden

[21] Appl. No.: 457,727

[22] PCT Filed: Jun. 16, 1988

[86] PCT No.: PCT/SE88/00328

§ 371 Date: Feb. 26, 1990

§ 102(e) Date: Feb. 26, 1990

[87] PCT Pub. No.: WO88/10342

PCT Pub. Date: Dec. 29, 1988

[30] Foreign Application Priority Data

Jun. 26, 1987 [SE] Sweden ..... 8702668

[51] Int. Cl.[5] ..... E02F 3/85; E01H 6/00

[52] U.S. Cl. ..... 172/4.5; 172/795; 172/1; 91/447; 60/494

[58] Field of Search ..... 172/2, 4.5, 260.5, 795; 91/6, 447, 413, 437, 518; 60/494

[56] References Cited

U.S. PATENT DOCUMENTS

| | | | |
|---|---|---|---|
| 3,635,020 | 1/1972 | Mahlmann | 91/6 X |
| 3,709,103 | 1/1973 | Dukhovny et al. | 91/437 |
| 3,872,670 | 3/1975 | Dezelan et al. | 60/413 |
| 4,024,796 | 5/1977 | Theobald | 91/437 X |
| 4,372,193 | 2/1983 | Hall | 91/518 X |
| 4,852,660 | 8/1989 | Leidinger et al. | 172/795 |

OTHER PUBLICATIONS

"Hydraulics. Theory and Applications," Robert Bosch GmbH, Jul. 1984, p. 235.

*Primary Examiner*—Dennis L. Taylor
*Assistant Examiner*—Jeffrey L. Thompson
*Attorney, Agent, or Firm*—Fleit, Jacobson, Cohn, Price, Holman & Stern

[57] ABSTRACT

By providing the work blade of a grader with a hydraulic regulation system where pressure limiting valves (14, 15, 16, 17) guide pressure reducing valves (10, 11, 12, 13) a constant pressure regulation of the work blade is achieved so that the work pressure set by the operator from his cab is maintained almost independent of the irregularities of the underlying surface.

4 Claims, 2 Drawing Sheets

CONSTANT PRESSURE REGULATION OF GRADER BLADES

TECHNICAL FIELD

The present invention relates at first to a device for constant pressure regulation of grader blades for the preparation of roadways. The invention has at first been developed for graders but can also e.g. be used for snow-ploughs and other devices doing road surface work or other surface work.

Consequently, the invention relates to the hydraulic system used to regulate grader blades and excavator blades on graders and other work machines used both for snow removing purposes and for construction work (compare the Swedish patent application 8402517-0).

The terminology used for workblades in relation to work machines are that the term "excavator blade" is used for processing and transport of masses and that the term "grader blade" is used as a definition of the workblade normally arranged under a grader and between its front and rear pair of wheels. The term "workblade" therefore comprises these two types of blades. Hereafter in the description the term "grader blade" is used as a definition of the workblade but naturally other types of workblades are included. Furthermore the term "cutting edge" is used for the outmost edge of a workblade.

BACKGROUND ART

The method of placing a road-grader blade against the roadway has almost been unchanged since road-grader blades for the first time were taken into use many centuries ago. The force used to press the cutting edge against the roadway has always been estimated by the operator without any special means of assistance. Consequently, the applied force differs a lot in magnitude in each specific case and was fully dependent of the actual operator's experience and skill. Consequently, the work carried out has been more dependent of the operator's experience and skill than of the hardness and the geometric profile of the foundation. Road work carried out has therefore varied a lot in quality. When the road-grader blade has been pressed towards the roadway with a force not big enough the result of the work carried out was of bad quality. When the road-grader blade has been pressed towards the roadway with a force too big, damages in the roadway have occured and also resulted in too quick wear of the cutting edge which caused enormous costs in changes.

THE PURPOSE OF THE INVENTION

The purpose with the present invention is to produce a method and a means possible provide constant pressure regulation of a road-grader blade so that the cutting edge is always pressed towards the roadway with optimum force related to each job opportunity independent of the operator's experience and skill. The device makes it possible to maintain a constant contact pressure between the cutting edge and the roadway also at variations in the hardness of the roadway, geometric shape and macrostructure. The device also maintains constant pressure when the road-grader blade is tilted or turned round its vertical axis and also in vertical curves.

Accordingly, the purpose of the invention is for example not to cut off the road surfaces or to damage pavements. Furthermore, the present invention provides a possibility to a larger extent than previous to predict when to exchange the cutting edge of a grader and so that the resources held by the stock of graders can be further optimized. The invention taken into practise by the hydraulic system described as follows, consequently gives constant contact force towards the roadway independent of the shape of the roadway. The contact force in the embodiment described is electrically operated from the drivers cab separately for each cylinder (first and second).

A further purpose with the invention is to solve the problems related to the difficulties that arose in the winter when a grader is going to cut the roadways and the pavements clean from snow and ice. It is then very difficult for the operator to adapt the vertical force of the road-grader blade, in other words the pressure of the road-grader blade towards the roadway so that the roadway and e.g. adjacent pavements are not scraped. Such damage causes great economic losses every year and is also very difficult to avoid. Furthermore, as previously mentioned an extremely high wear of the cutting edge of the grader blade is achieved which causes shorter intervals for exchange of the cutting edges as would be necessary if the wear of the cutting edges only was caused by normal use.

SUMMARY OF THE INVENTION

By forming the grader blade hydraulic circuit of a work machine in two separately and individually adjustable hydraulic circuits each separately operating the vertical force of the left and the right side of the grader blade towards the roadbed, an extended possibility to regulate the grader blade of the work machine is achieved. Together with this two-part separated hydraulic circuit the hydraulic circuits also contain the possibility for the operator to chose the ground pressure suitable under the present conditions. The operator has also the possibility in using "quick-driving" of the grader blade, meaning a momentary lowering of the grader blade. The operator can also from the drivers cab switch between constant pressure regulation of the grader blade and manual driving of the grader blade, meaning operation with a conventional hand lever operated valve.

BRIEF DESCRIPTION OF THE DRAWINGS

The invention will now be further described by working examples with numerals related to the enclosed drawings where.

DESCRIPTION OF THE INVENTION

Below, one mode of the invention applied to a grader will be described. Numerals in consecutive order to the figures makes it easier to understand the invention.

The grader blade on a road-grader is normally suspended between the front pair of wheels and the rear pair of wheels, that is centrally under the grader, in a table which can be operated from the drivers cab of the grader. The table can in this respect be turned so that the angle of the grader blade in relation to the driving-direction is changed. One hydraulic cylinder for vertical operation of the grader blade is mounted on each side of the grader. These hydraulic cylinders, hereafter called the first and the second hydraulic cylinder C1 and C2, are also operated by the operator from the drivers cab of the grader. With help from these cylinders the operator can e.g. choose the vertical force of the grader blade towards the roadbed whereby the roadbed establishes the vertical position of the grader blade.

Figure 1:
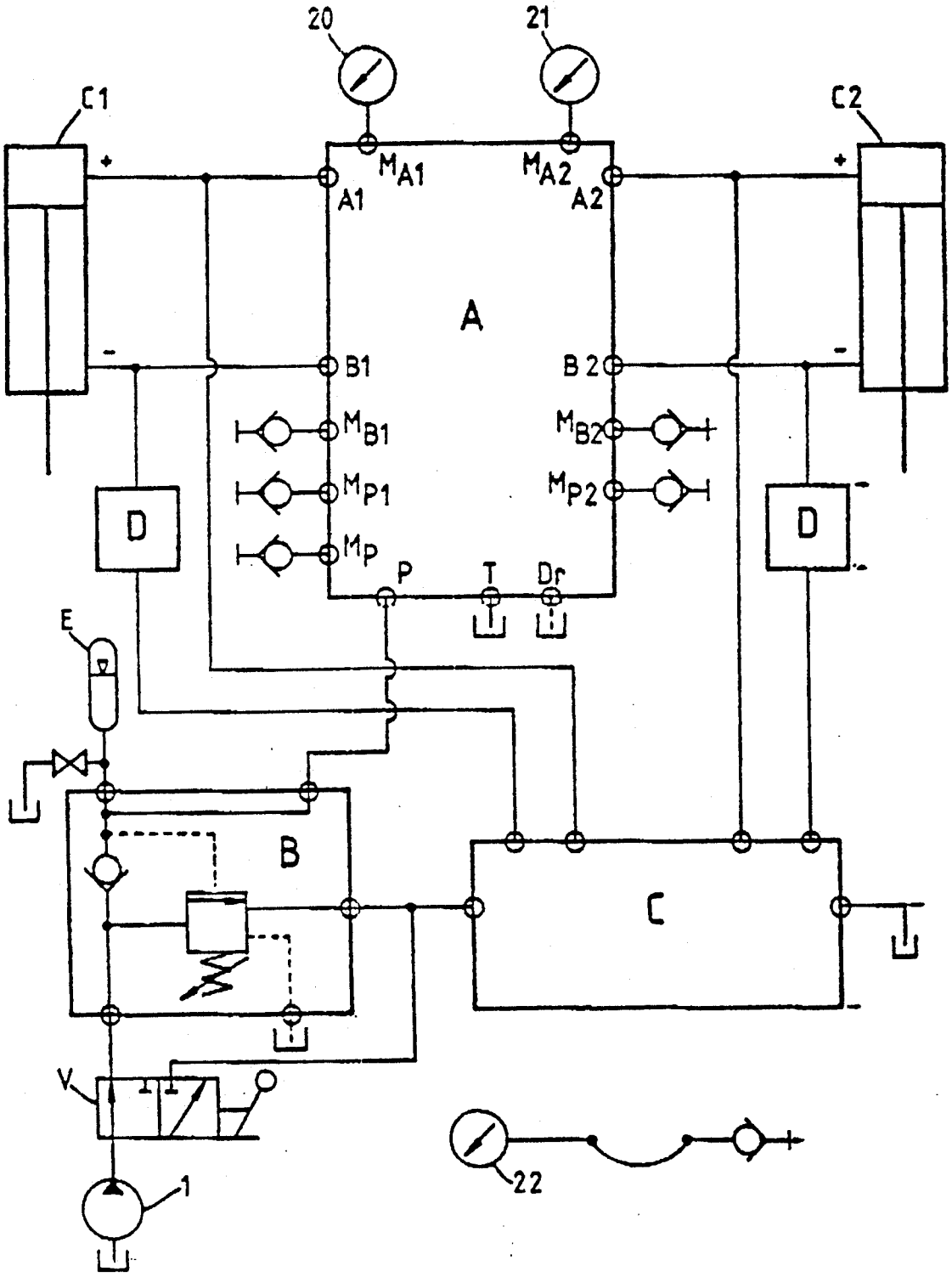
FIG. 1 shows a partly schematic hydraulic circuit according to the invention where the hydraulic circuits are shown as blocks

The hydraulic circuit in the block A in FIG. 1 is arranged with three bottom gates indicated P, T and Dr. The P-gate is connected to a pump 1 arranged to pressurize the hydraulic circuit A. The T-gate is connected to a tank for containing hydraulic fluid when the circuit A is being drained. The Dr-gate is used when draining the block of hydraulic fluid. One purpose of such a division of T-gate and Dr-gate is to avoid pressure variations which could affect the function of the circuit. Furthermore, the block A is provided with left plus-and minus gates A1, B1 for the left hydraulic cylinder C1 and right plus-and minus gates A2, B2 for the right hydraulic cylinder C2. Also, FIG. 1 shows the relation of the block A according to the rest of the blocks in the system for constant pressure regulation of the grader blade.

A block B is drawn in FIG. 1 to show a solution of the system of regulation if a pump which is not pressure compensated is used. This block is eliminated if a pressure compensated pump is used and the block B is then replaced by a T-coupling with connections from the pump being pressure compensated to the P-gate at the block A and to a hand lever valve of conventional type. The valve V in direct connection to the pump 1 is drawn as a suggestion to arrange a choice possibility between the conventional hand lever valve, the block C, and the constant pressure regulation, block A. The valve V is hereby drawn as a manually operated valve, operated by the operator from the driver's cab of the grader. Depending on the choice of a hand lever valve the valve V is chosen. If a pressure compensated pump is used and the block B is replaced by a T-coupling another type of hand lever valve is preferably chosen so that the valve V can be excluded. Further, the block B is arranged with an expansion tank E in order to eliminate hydraulic fluid via a drain valve if the pressure increases beyond the allowed level. This expansion tank is also eliminated if a pressure compensated pump is used.

Further, a block C is drawn into FIG. 1 in order to indicate the normal function of the hand lever valve in formerly used regulation systems for graders. This block is not shown in detail in the present invention since the hand lever valve is of conventional type and therefore is of ordinary shape and function.

Also, there are two blocks D indicating back pressure valves arranged at each cylinder (C1, C2) in order to prevent leakage from the minus-sides of the cylinders (C1, C2) to the tank. This is a nominal arrangement together with hand lever valves of the slide type to prevent the grader blade falling.

Figure 2:
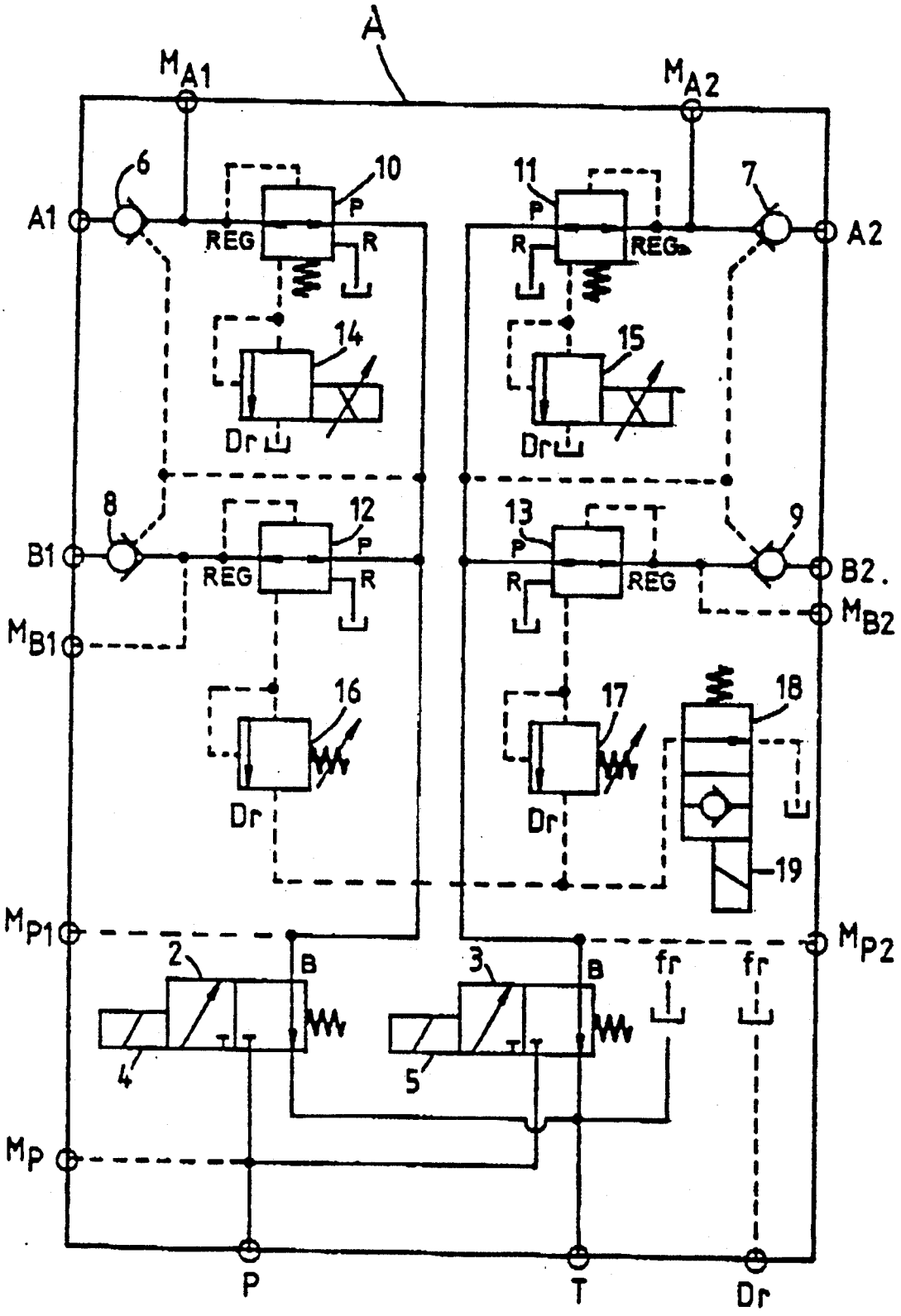
FIG. 2 shows the hydraulic circuit in the block A in FIG. 1

The P- and the T-gates are, see FIG. 2, inside the block A connected to at least one 4-way electric directional valve which in its normal position keeps the hydraulic circuit drained from hydraulic fluid via the B-gate of the valve. The directional valve opens the hydraulic circuit so that hydraulic fluid from the pump can reach the circuit when the magnet of the valve is being influenced. In the mode of example shown in FIG. 2 a first 4-way electric directional valve 2 is provided for the first part of the block and a second 4-way electric directional valve 3 is provided for the other part of the block to pressurize and depressurize the parts of the hydraulic circuit A.

The hydraulic circuit A in the block is then equipped with a left plus-gate A1 and a left minus-gate B1 for the plus- and the minus-side of the left hydraulic cylinder C1. The plus-side is defined as the side of the cylinder which makes the piston-rod protrude when pressurized and the minus-side is defined as the side of the cylinder which makes the piston-rod retract into the cylinder when pressurized. Corresponding gates are arranged at the right hydraulic cylinder, that is one right plus-gate A2 and one right minus-gate B2.

These four cylinder gates A1, B1, A2 and B2 in the block are each connected to a pilot operated back valve so that the left plus-gate A1 is connected to a first back valve 6, the right plus-gate A2 is connected to a second back valve 7, the left-minus gate B1 is connected to a third back valve 8 and the right minus-gate B2 is connected to a fourth back valve 9. All back valves are, as previously mentioned, pilot operated so that they open at a specific input pressure in the hydraulic circuit A.

Each of these back valves 6, 7, 8, 9 are connected to the directional valves 2, 3 via the REG-gate on each of four 3-way pressure reducing valves so that the first back valve 6 is connected to a first pressure reducing valve 10, the second back valve 7 is connected to a second pressure reducing valve 11, the third back valve 8 is connected to a third pressure reducing valve 12 and the fourth back valve 9 is connected to a fourth pressure reducing valve 13. Then each pressure reducing valve 10, 11, 12 and 13 is provided with a drain-gate R to the tank. Each pressure reducing valve is pressure controlled so that the stream of fluid is accepted to a predetermined level of pressure in one direction and if the level is exceeded the stream of fluid changes direction and will be drained by the R-gates of the valves. Further, each pressure reducing valve 10, 11, 12 and 13 is connected each one to a pressure limiting valve so that the first pressure reducing valve 10 is operated by a first proportional pressure limiting valve 14 so that a predetermined pressure set by this valve 14 maintains the pressure at the REG-gate of the pressure reducing valve 10. Further, the second pressure reducing valve 11 is operated by a second proportional pressure limiting valve 15 so that in the same way a predetermined pressure set by this valve 15 maintains the pressure at the REG-gate of the pressure reducing valve 11. The third pressure reducing valve 12 is operated by a first pressure limiting valve 16 and the fourth pressure reducing valve 13 is operated by a second pressure limiting valve 17. The purpose of the two pressure limiting valves 16, 17 are to calibrate the scales of the proportional pressure limiting valves 14 and 15. The calibration is carried out so that the zero-level on the proportional pressure limiting valves 14 and 15 correspond to the "float-level" on the grader blade, that is the condition when the blade is slowly moving upwards from the roadway. Besides, each pressure limiting valve 14, 15, 16, 17 is equipped with a draining gate Dr for externally draining, whereby the draining gates Dr of the first and the second pressure limiting valves 16, 17 are connected to an electrically operated 2-way directional valve 18 having a magnet 19. The directional valve 18 makes it possible to eliminate the draining of the first and the second pressure limiting valves 16, 17 so that a fast lowering of the grader blade is achieved.

A first pressure gauge 20 is directly connected to the plus-side of the left hydraulic cylinder C1 via the connection $M_{A1}$ of the hydraulic circuit A and a second pressure gauge 21 is directly connected to the plus-side of the right hydraulic cylinder C2 via the connection $M_{A2}$ of the hydraulic circuit A so that the operator directly can read the hydraulic pressure out to the plus-sides of the cylinders. There is also a separate third pressure gauge 22 belonging to the system in order to be connected to the hydraulic circuit A at a number of measuring points $M_{B1}$, $M_{B2}$, $M_{P1}$ and $M_{P2}$ arranged as measuring connectors. At the connectors $M_{B1}$ and $M_{B2}$ measures of the minus-sides of the hydraulic cylinders C1, C2 are carried out, at the connectors $M_{P1}$ and $M_{P2}$ measures of the input pressure at the left and at the right side of the hydraulic circuit A are carried out. The measuring connector $M_P$ is used for examining the total input pressure of the circuit A, that is just in front of the two directional valves 2, 3.

The function of the block A, that is the hydraulic circuit A is described below mainly with references to FIG. 2.

The hydraulic circuit A (in this case block A in FIG. 2) is fed with constant pressure by a hydraulic pump 1 (shown in FIG. 1) in its P-gate (FIG. 2). The pressure is then blocked by a first electrically operated 3-way directional valve 2 and a second electrically operated 3-way directional valve 3 when the magnets 4, 5 of the directional valves 2, 3 are deactivated (the normal position shown in FIG. 2). At the same time the system is drained and that is when the B-gates of the directional valves 2, 3 are connected to a tank via the T-gate (FIG. 2) and the four pilot operated back valves 6, 7, 8, 9 are closed. Accordingly the hydraulic circuit A is deactivated and "normal" driving of the grader blade via the hand lever valve (shown only in block C in FIG. 1) is possible.

Activation of the hydraulic circuit A is carried out when a voltage activates the magnets 4, 5 of the directional valves 2, 3 so that the pressure can enter the two separate hydraulic circuits. The block A in FIG. 2 is divided into one separate hydraulic circuit for each hydraulic cylinder C1 and C2.

Feeding pressure has therefore reached the front of the P-gates of the four 3-way pressure reducing valves. Pilot pressure (=input pressure) opens simultaneously the four pilot operated back valves 6, 7, 8, 9. The pressure out to the gates of the hydraulic cylinders C1, C2 via the REG-gates of the pressure reducing valves 10, 11, 12, 13 is established by the setting of the four pressure limiting valves 14, 15, 16, 17 which operate as pilot valves for the pressure reducing valves 10, 11, 12, 13 where as previously mentioned the pilot valves 14 and 15 are proportional pressure limiting valves and the pilot valves 16 and 17 are ordinary pressure limiting valves.

The adjustment of the floating point of the grader blade is done by setting the two proportional limiting valves 14 and 15 to a minimum value, that is O-position on the two scales connected to the valves, so that "zero-pressure" reach the plus-sides of the hydraulic cylinders C1, C2. Then the pressure limiting valves 16 and 17 are pressure adjusted to a value so that the grader blade is lifting from the roadbed and slowly moving upwards, that is the contact force towards the roadway is 0.

The pressure towards the roadway is then selected by the operator from the operators cab by the two proportional pressure limiting valves 14 and 15. The valves 14, 15 are electrically operated via a potentiometer and a guide card separately for each hydraulic cylinder C1 and C2.

The four 3-way pressure reducing valves 10, 11, 12, 13 operate both as pressure reducing valves and as pressure limiting valves in the hydraulic circuit A. That is, if the level of the set pressure at the REG-gates of the pressure reducing valves 10, 11, 12, 13 has not been reached, these valves are open (P to REG) and hydraulic fluid is filled until set pressure is reached.

If the pressure reaches a higher value than set by the pressure limiting valves 14, 15, 16, 17 the pressure reducing valves 10, 11, 12, 13 change function and open the connections from their REG-gates to their R-gates which are connected to to the tank so that the pressure is drained until set value on the REG-gate of the valves are attained.

Activation of the magnet 19 of the electric directional valve 18 means "quick-driving" (also known as differential-driving, which imply a fast lowering of the grader blade) of the hydraulic cylinders in the plus-direction if at the same time maximum pressure (about 80–100 bar) is given to the proportional pressure limiting, valves 14 and 15.

In order to make the hydraulic cylinders move in the plus-direction the dead weight of the grader blade (about 2000–2500 kg) must effect the hydraulic cylinders C1, C2. In this case the pressure reducing valves 12 and 13 at the minus-sides of the hydraulic cylinders C1, C2 are forced to the open position (P to REG) and the minus-sides of the cylinders are connected to feeding pressure (=max 160 bar). If at the same time the pressure reducing valves 10 and 11 are being set by the proportional pressure limiting valves 14 and 15 so that the pressure transmitted to the plus-sides of the hydraulic cylinders reaches 80–100 bar the hydraulic cylinders move in the plus-direction and a fast lowering of the grader blade is achieved.

The invention can within the scope of the following claims be used by different types of work machinery where constant pressure regulation of the work blade of the machine is desirable. The invention is therefore not limited to concern only a road machine or a road grader.

We claim:

1. A method of regulating pressure on a work blade on a road machine so that a hydraulic system with a first hydraulic cylinder (C1) and a second hydraulic cylinder (C2) regulates the vertical force of the work blade towards an underlying surface, characterized by that the hydraulic system regulates the vertical force of the work blade towards the underlying surface whereby the setting of the work pressure at the first hydraulic cylinder (C1) by a first pressure limiting valve (14) and the setting of the work pressure at the second hydraulic cylinder (C2) by a second pressure limiting valve (15) is maintained when the first pressure limiting valve (14) is guiding a first pressure reducing valve (10) and the second pressure limiting valve (15) is guiding a second pressure reducing valve (11) at plus-sides of the hydraulic cylinders and that one more pressure limiting valve (16) is guiding a third pressure reducing valve (12) and that one more pressure limiting valve (17) is guiding a fourth pressure reducing valve (13) in order to balance the pressure at minus-sides of the hydraulic cylinders (C1,C2).

2. Device for constant pressure regulation of a work blade on a road machine where a hydraulic system comprising a first hydraulic cylinder (C1) operating on one side of the work blade and a second hydraulic cylinder (C2) operating on the other side of the work blade is arranged to regulate the vertical force of the work blade towards the underlying surface, characterized by that each hydraulic cylinder (C1,C2) is fed with a constant pressure at a plus-side of each cylinder and a constant pressure at a minus-side of each cylinder and that these pressures, are maintained by the arrangement of two pressure reducing valves (10,11) operated by two proportionally pressure limiting valves (14,15) on the plus-sides of the hydraulic cylinders and by the arrangement of two more pressure reducing valves (12,13) operated by two more pressure limiting valves (16,17) in order to balance the pressure on the minus-sides of the hydraulic cylinders.

3. A hydraulic system according to claim 2, characterized by that differential driving is achieved by a directional valve (18) mounted in order to stop the draining of the minus-sides of the pressure limiting valves (16,17).

4. Device according to claim 3, characterized by that the constant pressure regulation hydraulic circuit (A) of the work blade is provided as an alternative to an existing hand lever valve in a road machine.

* * * * *